US006930271B1

(12) United States Patent
Palmieri et al.

(10) Patent No.: US 6,930,271 B1
(45) Date of Patent: Aug. 16, 2005

(54) CIRCUIT INTERRUPTER INCLUDING LINEAR ACTUATOR AND MANUAL PIVOT MEMBER

(75) Inventors: Daniel E. Palmieri, Hopewell Township, PA (US); Robert N. Krevokuch, West Newton, PA (US); Brad R. Leccia, Bethel Park, PA (US); John J. Hoegle, Beaver, PA (US); Henry J. Remic, Export, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/918,524

(22) Filed: Aug. 13, 2004

(51) Int. Cl.[7] ..... H01H 33/66; H01H 3/00; H01H 33/02

(52) U.S. Cl. ..... 218/154; 218/119; 218/120; 218/152; 218/153

(58) Field of Search ..... 218/118–120, 140, 218/152–154; 361/71, 72, 115; 200/18, 329, 200/400

(56) References Cited

U.S. PATENT DOCUMENTS

| | | | | | |
|---|---|---|---|---|---|
| 3,567,886 | A | * | 3/1971 | Ross | 218/153 |
| 4,016,385 | A | * | 4/1977 | Golioto | 218/140 |
| 4,034,264 | A | * | 7/1977 | Muller et al. | 218/118 |
| 4,272,687 | A | | 6/1981 | Borkan | |
| 4,471,797 | A | | 9/1984 | Cass et al. | |
| 4,490,593 | A | * | 12/1984 | Cook | 218/152 |
| 4,611,620 | A | | 9/1986 | Wang | |
| 5,397,868 | A | * | 3/1995 | Smith et al. | 200/18 |
| 5,422,453 | A | * | 6/1995 | Smith et al. | 200/329 |
| 5,628,394 | A | * | 5/1997 | Benke et al. | 200/400 |
| 5,652,416 | A | | 7/1997 | Sharaf et al. | |
| 5,936,817 | A | | 8/1999 | Matsko et al. | |
| 6,242,708 | B1 | | 6/2001 | Marchand et al. | |
| 6,326,872 | B1 | | 12/2001 | Marchand et al. | |
| 6,362,445 | B1 | | 3/2002 | Marchand et al. | |
| 6,365,993 | B1 | | 4/2002 | Calhoon et al. | |
| 6,373,015 | B1 | | 4/2002 | Marchand et al. | |
| 6,373,358 | B1 | | 4/2002 | Davies et al. | |
| 2004/0118815 | A1 | | 6/2004 | Marchand et al. | |

* cited by examiner

*Primary Examiner*—James R. Scott
(74) *Attorney, Agent, or Firm*—Martin J. Moran

(57) ABSTRACT

A power circuit interrupter includes a housing having an opening, one or more vacuum interrupters including separable contacts, and an operating mechanism, supported by the housing, adapted to open and close the contacts. A linear actuator cooperates with the operating mechanism to open and close the contacts, and is responsive to a close signal to close the contacts. A pivotable trip member protrudes through the opening of the housing and cooperates with the operating mechanism and the linear actuator to open the contacts when pivoted from a first position to a second position. A close circuit includes an input inputting the close signal. A micro-switch includes an operator and a contact electrically connected in series with the input of the close circuit. The operator is engaged by the pivotable trip member to open the contact in response to partial pivoting thereof from the first position toward the second position.

27 Claims, 13 Drawing Sheets

INCOMING V+
POWER SOURCE
INCOMING V-
151
153
155
CONTROLLER
μP
189
71
173
79
73
167
169
171
81
77
175
177
LED
39
40
161
96 VDC
GND
AUX 1
AUX 2
163
83
SWITCH 2
145
93
SWITCH 1
89
AUX 3
AUX 4
165
85
87
OUT V
POWER SUPPLY
GND
IN
IN
159
157
SWITCH 4
141
37
CLOSE PUSH BUTTON
69
REMOTE CLOSE
75
REMOTE OPEN
OPEN PUSH BUTTON
38
149
SWITCH 3

CIRCUIT INTERRUPTER INCLUDING LINEAR ACTUATOR AND MANUAL PIVOT MEMBER

BACKGROUND OF THE INVENTION

1. Field of the Invention

This invention pertains generally to circuit interrupters and, more particularly, to such circuit interrupters employing one or more pole mechanisms.

2. Background Information

Circuit interrupters provide protection for electrical systems from electrical fault conditions such as, for example, current overloads, short circuits and abnormal level voltage conditions. Typically, circuit interrupters include a spring powered operating mechanism which opens electrical contacts to interrupt the current through the conductors of an electrical system in response to abnormal conditions.

Circuit interrupters, such as, for example, power circuit breakers for systems operating above about 1,000 volts typically utilize vacuum interrupters as the switching devices. For the higher voltages, or for a more compact arrangement, each vacuum interrupter is housed in a separate pod molded of an electrically insulative material, such as a polyglass. These molded pods, in turn, are bolted to a metal box containing the operating mechanism. The metal box is grounded to isolate the operating mechanism from the line voltage of the power circuit. Manual controls for the operating mechanism are accessible at the front face of the metal box. See, for example, U.S. Pat. No. 6,373,358.

Vacuum circuit interrupter apparatus include separable main contacts disposed within an insulating housing. Generally, one of the contacts is fixed relative to both the housing and to an external electrical conductor which is interconnected with the circuit to be controlled by the circuit interrupter. The other contact is moveable. In the case of a vacuum circuit interrupter, the moveable contact assembly usually comprises a stem of circular cross-section having the contact at one end enclosed within a vacuum chamber and a driving mechanism at the other end which is external to the vacuum chamber. An operating rod assembly comprising a push rod, which is fastened to the end of the stem opposite the moveable contact, and a driving mechanism provide the motive force to move the moveable contact into or out of engagement with the fixed contact.

The operating rod assembly is operatively connected to a latchable operating mechanism which is responsive to an abnormal current condition. When an abnormal condition is reached, the latchable operating mechanism becomes unlatched which causes the operating rod to move to the open position. The motion of the operating rod, in turn, causes a contact bell crank to rotate and this controls motion of the moveable contact.

Compression springs are provided in connection with the operating rod assembly in order to be able to separate the moveable contact from the fixed contact and to assure the necessary force so that the contacts will not accidentally open under inappropriate conditions. In addition, when appropriate circumstances requiring interruption of the circuit do arise, an adequate force is needed to open the contacts with sufficient speed. If the contacts do not open quickly, then there is a risk of the contacts welding together and failure to interrupt the current.

Vacuum interrupters are typically used, for instance, to reliably interrupt medium voltage alternating current (AC) currents and, also, high voltage AC currents of several thousands of amperes or more. Typically, one vacuum interrupter is provided for each phase of a multi-phase circuit and the vacuum interrupters for the several phases are actuated simultaneously by a common latchable operating mechanism.

U.S. Patent Application Publication No. 2004/0118815 discloses an electrical interrupter apparatus including an interruption device, an insulation member, a base, a driving system and a linkage mechanism. A plurality of the electrical interrupter apparatuses may be incorporated into a circuit breaker, such as a 72.5 kV outdoor circuit breaker or other circuit breaker. The driving system includes a drive unit and a return spring. The drive unit is mounted within the base and can be any of a wide variety of mechanical devices suited to rapidly provide a sufficient level of force at a sufficient speed to operate the interruption device in an appropriate fashion. The drive unit may be of a variety of different configurations, and may be, for instance, a motor, a solenoid, a permanent magnet linear actuator, or other appropriate device.

U.S. Pat. No. 6,362,445 discloses a breaker module comprising a vacuum interrupter/linear actuator assembly. The vacuum interrupter portion of the breaker module is a conventional circuit breaker vacuum interrupter design including a moveable contact stem/push rod assembly that is connected to the armature of an in-line actuator, which drives the moveable contact into or out of engagement with a stationary contact in response to an input of an appropriate drive signal. The in-line actuator is of conventional design and consists of either one or two electrically wound coils wound around a magnetically permeable, hollow form positioned adjacent a hollow rare earth magnet. In the single coil design, voltage of a given polarity is applied to the coil to move the armature in a first direction and voltage of the opposite polarity is applied to the coil to move the armature in the opposite direction. In the two coil design, the magnet is interposed between the two coils and the armature is disposed in the hollow center. Voltage is applied to the first coil in a first direction to cause movement of the armature in one direction and voltage is applied to the second coil in the opposite direction to cause opposite movement of the armature.

In the event of a loss of power or other failure, there is a need to permit an operator to manually open the vacuum interrupter.

There is also a need for manual operation that is safe and reliable.

Accordingly, there is room for improvement in vacuum circuit interrupters employing an actuator.

SUMMARY OF THE INVENTION

These needs and others are met by the present invention, which provides a linear actuator circuit interrupter including an integral emergency trip member for use in case of a power loss. An operator employs the emergency trip member to open the circuit interrupter by pivoting the member towards the operator.

As another aspect of the invention, in the event that a close signal is initiated while the operator is holding the emergency trip member, then the member may be, otherwise, violently forced back toward the circuit interrupter along with the operator's hand. The circuit interrupter includes a normally closed micro-switch in the close circuit thereof. The micro-switch normally closed contact is opened by movement of the circuit interrupter emergency trip member. When the emergency trip member is slightly pulled by an operator, the micro-switch normally closed contact switches to an open state, in order to disable a close signal in the close circuit. The close signal may originate, for example, from a close pushbutton, a close switch or an incoming close signal from an external source.

In accordance with one aspect of the invention, a circuit interrupter comprises: a housing having an opening; at least one pole mechanism comprising separable contacts; an operating mechanism adapted to open and close the separable contacts of the at least one pole mechanism, the operating mechanism being supported by the housing; an actuator cooperating with the operating mechanism to open and close the separable contacts, the actuator being responsive to a close signal to close the separable contacts; a member protruding through the opening of the housing and cooperating with the operating mechanism to open the separable contacts when moved from a first position to a second position; a close circuit including an input inputting the close signal; and a switch including an operator and a contact electrically connected in series with the input of the close circuit, the operator being engaged by the member to open the contact in response to partial movement of the member from the first position toward the second position.

The member may be a pivotable emergency trip lever protruding through the opening of the housing and cooperating with the operating mechanism and the actuator to trip open the separable contacts when pivoted to the second position.

The pivotable emergency trip lever may include a normal position as the first position, an open position as the second position and an engagement position between the normal position and the open position. The pivotable emergency trip lever may engage the operator of the switch in the engagement position.

The engagement position is preferably substantially closer to the normal position than the open position.

The actuator may be a linear actuator including an armature moveable in a longitudinal direction. The at least one pole mechanism may include at least one vacuum interrupter having a moveable stem mechanism. The operating mechanism may include a pole shaft having an arm engaging the moveable stem mechanism and another arm engaging the armature of the linear actuator.

The at least one pole mechanism may include a plurality of vacuum interrupters having a plurality of movable stem mechanisms. The operating mechanism may include a pole shaft having a first arm, a second arm and a plurality of third arms each of which engages a corresponding one of the movable stem mechanisms. The linear actuator may include an armature engaging the second arm of the pole shaft. The member may be a pivot member including a linkage between the pivot member and the operating mechanism to open the separable contacts when the pivot member is pivoted to the second position. The linkage may include a link member engaging the first arm of the pole shaft.

The pivot member may include a leg. The linkage may include a first link pivotally mounted to the leg of the pivot member, a second link pivotally mounted to the first link, and the link member pivotally mounted to the second link.

The link member may include a longitudinal slot. The first arm of the pole shaft may include a pivot point pivotally captured within the longitudinal slot.

The second link may include a first pivot point pivotally mounted to the first link, a second pivot point pivotally mounted to the link member and a third pivot point pivotally mounted to the housing.

The longitudinal slot may include an end. The pivot point of the first arm of the pole shaft may engage the end of the longitudinal slot when the separable contacts are closed. When the pivot member is pivoted to the second position, the leg of the pivot member moves the first link in a longitudinal direction, which pivots the second link about the third pivot point, which moves the link member in the longitudinal direction, in order that the end of the longitudinal slot pivots the first arm of the pole shaft, the pole shaft pivoting the second arm thereof to move the armature of the linear actuator. The operating mechanism may include an opening spring biasing the pole shaft with a first force. The linear actuator may include a magnet having a second force that is greater than the first force until the end of the longitudinal slot pivots the first arm of the pole shaft, which pivots the second arm thereof to move the armature of the linear actuator, in order to open the separable contacts.

As another aspect of the invention, a power circuit interrupter comprises: a housing having an opening; at least one vacuum interrupter comprising separable contacts; an operating mechanism adapted to open and close the separable contacts of the at least one vacuum interrupter, the operating mechanism being supported by the housing; a linear actuator cooperating with the operating mechanism to open and close the separable contacts, the linear actuator being responsive to a close signal to close the separable contacts; a pivot member protruding through the opening of the housing and cooperating with the operating mechanism and the linear actuator to open the separable contacts when pivoted from a first position to a second position; a close circuit including an input inputting the close signal; and a switch including an operator and a contact electrically connected in series with the input of the close circuit, the operator being engaged by the pivot member to open the contact in response to partial pivoting of the pivot member from the first position toward the second position.

As another aspect of the invention, a power circuit interrupter comprises: a housing having an opening; at least one vacuum interrupter including separable contacts; an operating mechanism adapted to open and close the separable contacts of the at least one vacuum interrupter, the operating mechanism being supported by the housing; a linear actuator cooperating with the operating mechanism to open and close the separable contacts; a pivot member protruding through the opening of the housing; and a linkage between the pivot member and the operating mechanism to open the separable contacts when the pivot member is pivoted to an open position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The present invention is described in association with a power vacuum circuit breaker, although the invention is applicable to a wide range of circuit interrupters, including, but not limited to, other circuit breakers, load break switches, and switch disconnects.

Figure 1:
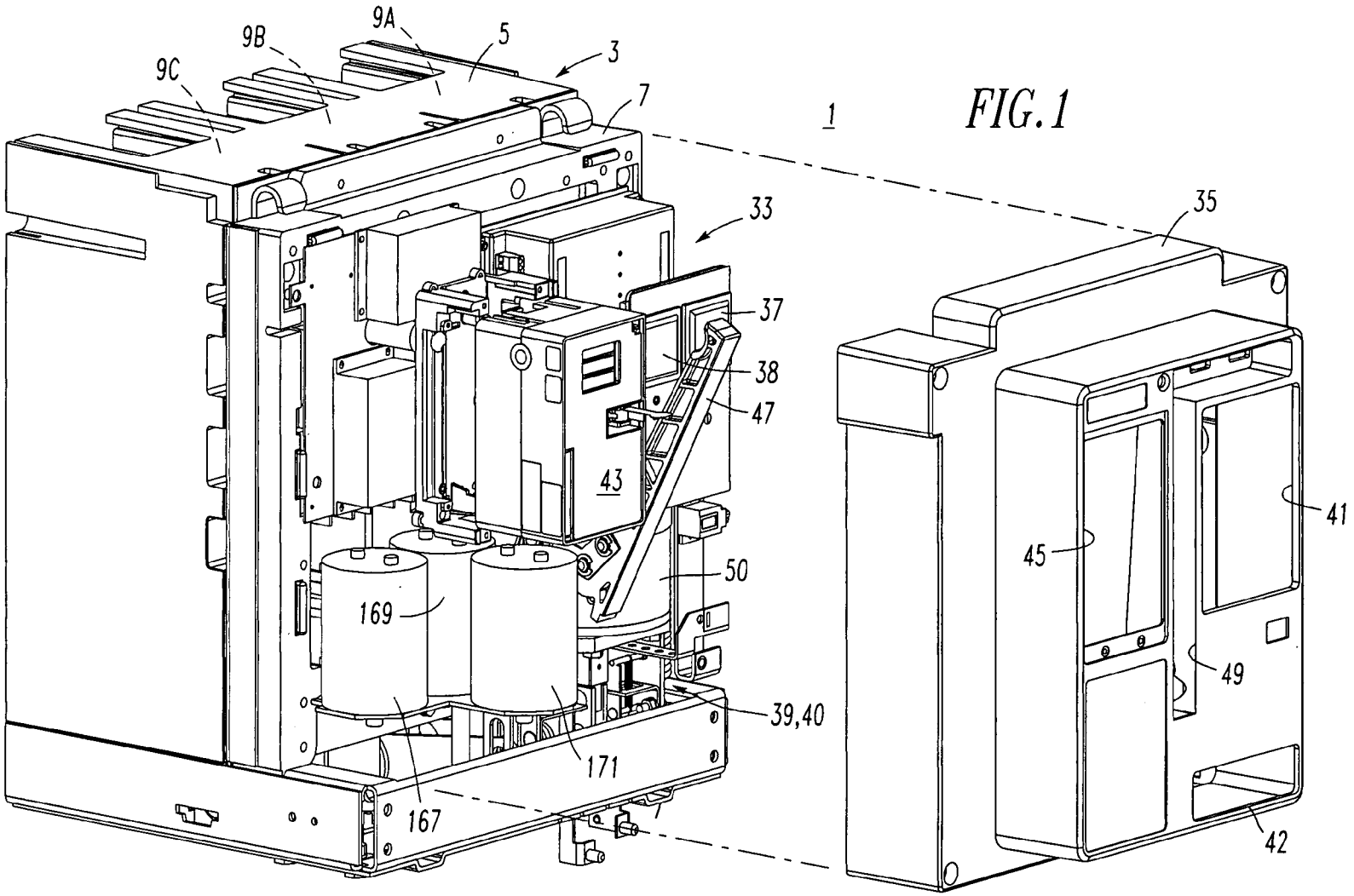
FIG. 1 is a front isometric view of a circuit breaker in accordance with the invention with the cover exploded to show internal structures.
Figure 2:
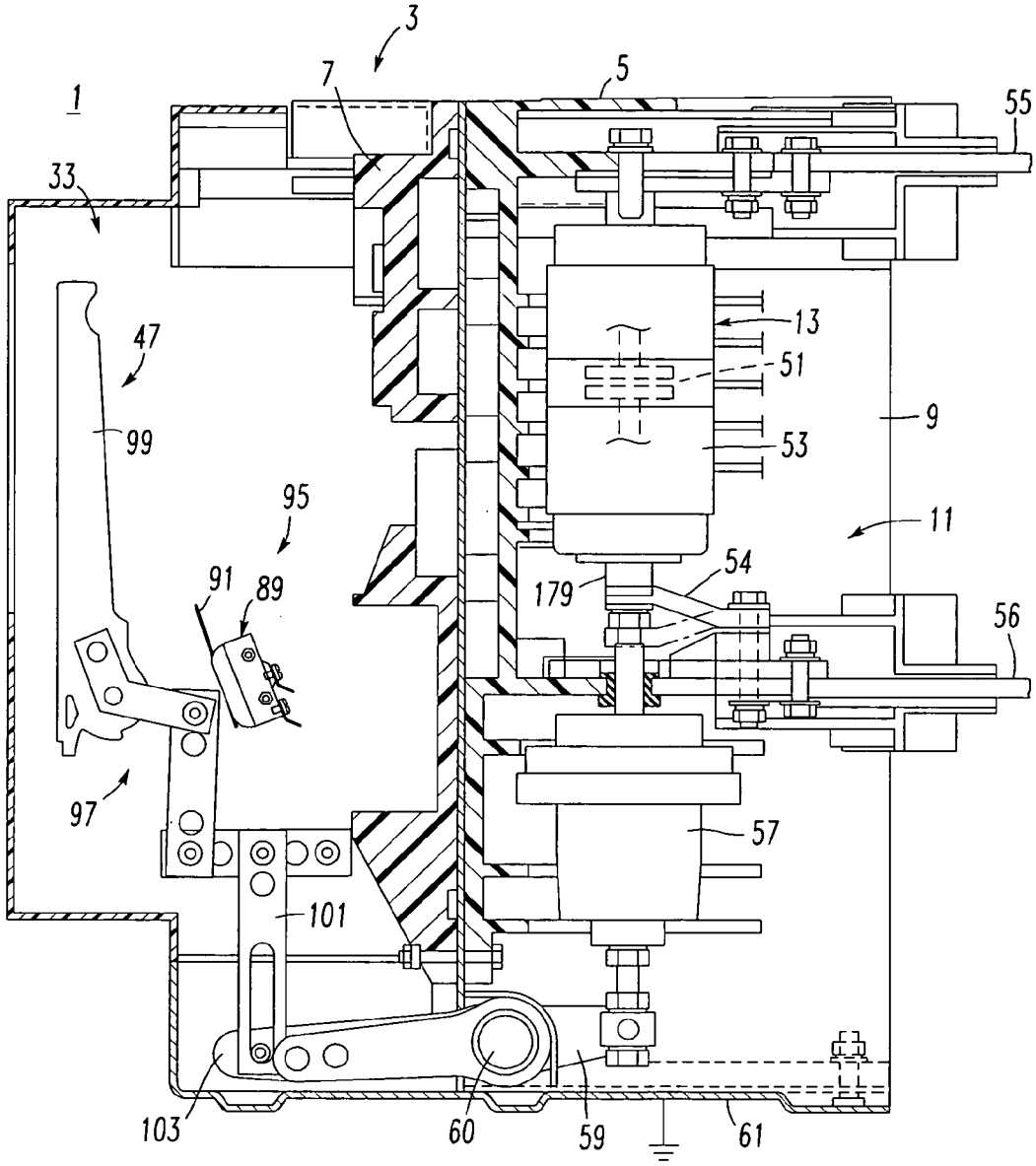
FIG. 2 is a longitudinal vertical section through the circuit breaker of FIG. 1.

Referring to FIG. 1, a three-pole power vacuum circuit breaker 1 includes a molded insulative casing 3 divided into a rear section 5 and a forward section 7. An example of the casing 3 and the rear section 5 is disclosed in U.S. Pat. No. 6,373,358, which is incorporated by reference herein. The rear casing 5 is preferably molded as a single piece with a plurality of pole cavities 9 (one of which is shown in FIG. 2). The exemplary circuit breaker 1 has three such pole cavities 9A,9B,9C, one for each phase of a three-phase power distribution system. Each of the pole cavities 9 houses a pole mechanism 11, which includes a vacuum interrupter 13 as is shown in FIG. 2.

Figure 10:
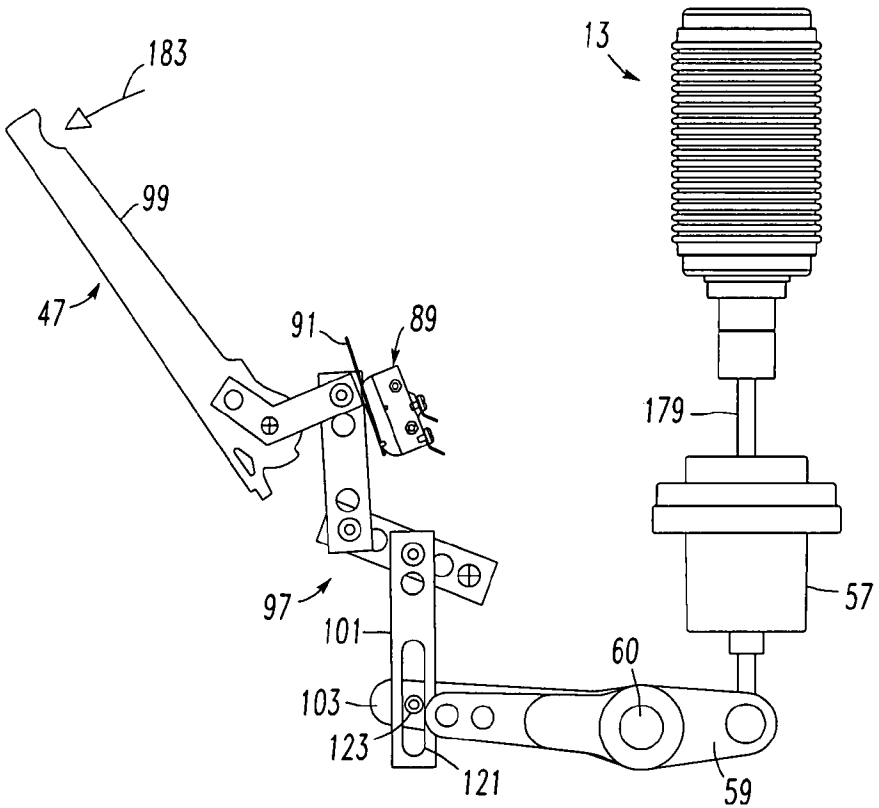
FIG. 10 is a simplified vertical side elevation view of the pivotable emergency trip lever, linkage, pole shaft and vacuum interrupter of FIG. 1 in the open position with the micro-switch in the open position and the emergency trip lever in the fully open position.

The power circuit breaker 1 further includes an operating mechanism 33 which is attached to the front of the forward section 7 of the molded insulative casing 3. The operating mechanism 33 is enclosed by a cover 35, which is preferably molded of an insulative material, again such as glass polyester. The operating mechanism 33 includes controls on its front face such as the pushbuttons 37,38 (FIG. 5) and indicators 39,40 (FIG. 5) which are accessible through two openings 41 and 42, respectively, in the cover 35. A trip unit 43 mounted on the front of the operating mechanism 33 is accessible through another opening 45 in the cover 35. In addition, a member, such as handle 47 for manually tripping open the operating mechanism 33, is accessible through an opening, such as slot 49 in the cover 35. In accordance with an important aspect of the invention, the handle 47 is a pivot member or pivotable emergency trip lever, which cooperates with the operating mechanism 33 and a linear actuator 50 (FIGS. 6A–6B and 14) (e.g., a solenoid; a magnetic actuator; an in-line actuator) to trip open the vacuum interrupters 13 when pivoted to an open position (FIG. 10).

As best shown in FIG. 2, each of the vacuum interrupters 13 has separable contacts 51 housed in a vacuum bottle 53. The upper or fixed contact of the separable contacts 51 is electrically connected to a line conductor 55, which extends rearward for connection to a utility bus (not shown). The lower, or moveable, contact of the separable contacts 51 is connected by a flexible shunt 54 to a load conductor 56, which likewise extends rearward for connection to a load bus (not shown). The moveable contact is mechanically connected through an insulator/compression spring 57, which provides electrical isolation and a spring bias, to an operating linkage in the form of a bell crank 59 of a pole shaft 60. The bell crank 59 is pivotally mounted in an electrically conductive pan 61 which extends under the molded insulative casing 3. The forward ends of the bell crank 59 are connected to the armature 63 (FIGS. 6B and 14) of the linear actuator 50 (FIGS. 6A–6B and 14) by an arm 65 (FIG. 6A) of the pole shaft 60.

The operating mechanism 33 includes an opening spring 67 (FIGS. 6A–6B), which is charged through operation of the linear actuator 50. The operating mechanism 33 is adapted to open and close the separable contacts 51. The separable contacts 51 in each of the three vacuum interrupters 13 are also closed either manually by depressing the close pushbutton 37, or remotely through a remote close contact 69 (FIG. 5), either of which is received by the trip unit controller 71 (FIG. 5), which responsively energizes the closing coil 73 of the linear actuator 50. The separable contacts 51 are opened utilizing the energy stored in the opening spring 67 of the operating mechanism 33. The separable contacts 51 can also be opened automatically by the trip unit controller 71 in response to certain current/time characteristics of current flowing through the circuit breaker 1, manually by pushing the appropriate open pushbutton 38, or remotely through a remote open contact 75 (FIG. 5), any of which is received or generated by the controller 71, which energizes the opening coil 77 of the linear actuator 50. The linear actuator 50 cooperates with the operating mechanism 33 to open and close the separable contacts 51, is responsive to a close signal 79 to close such contacts, and is response to an open signal 81 to open those contacts. The controller 71 drives the close signal 79 responsive to a close input 83 and drives the open signal 81 responsive to open inputs 85,87.

Figure 3:
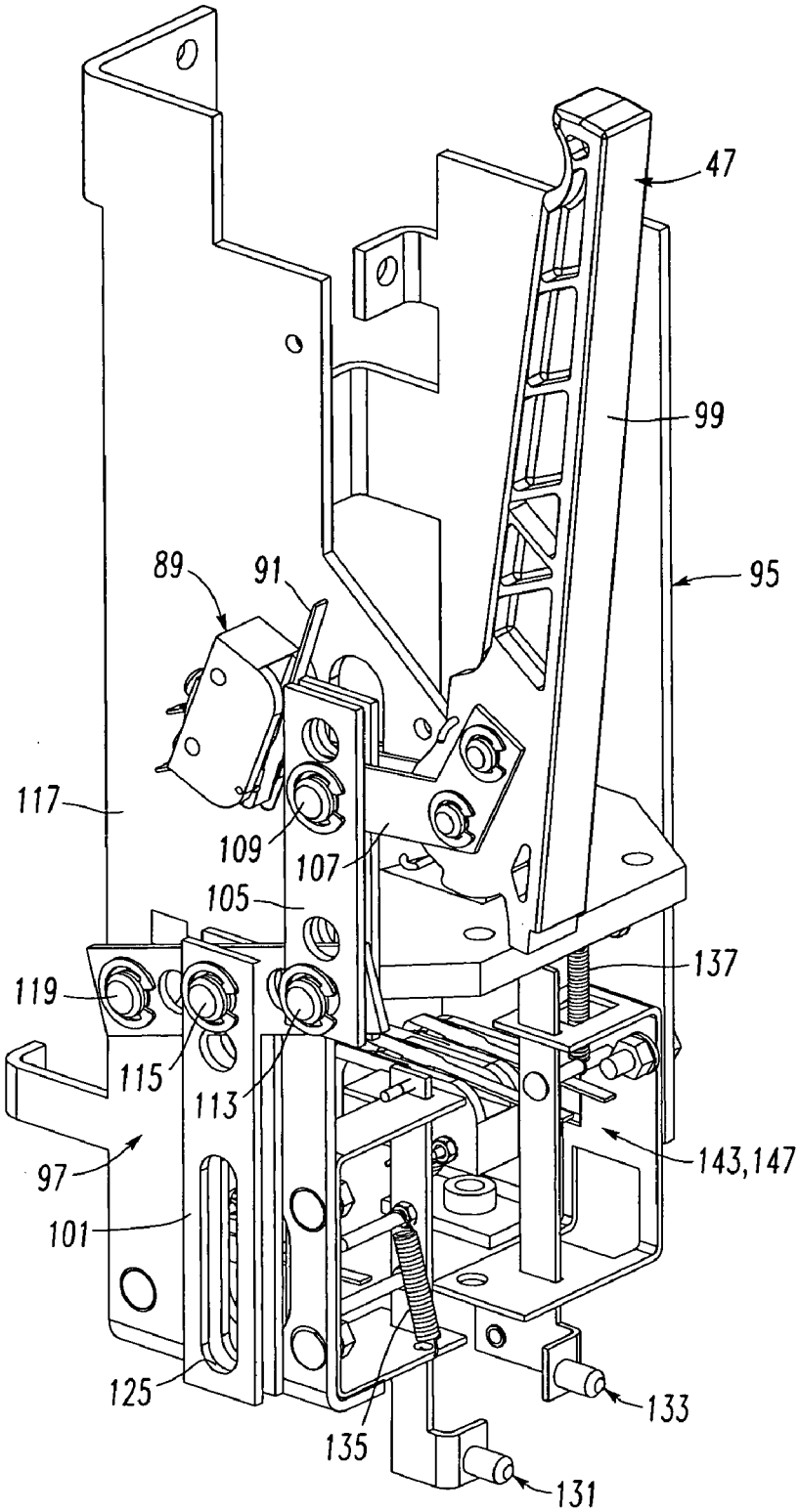
FIG. 3 is a side isometric view of an actuator box assembly of the circuit breaker of FIG. 1.
Figure 5:
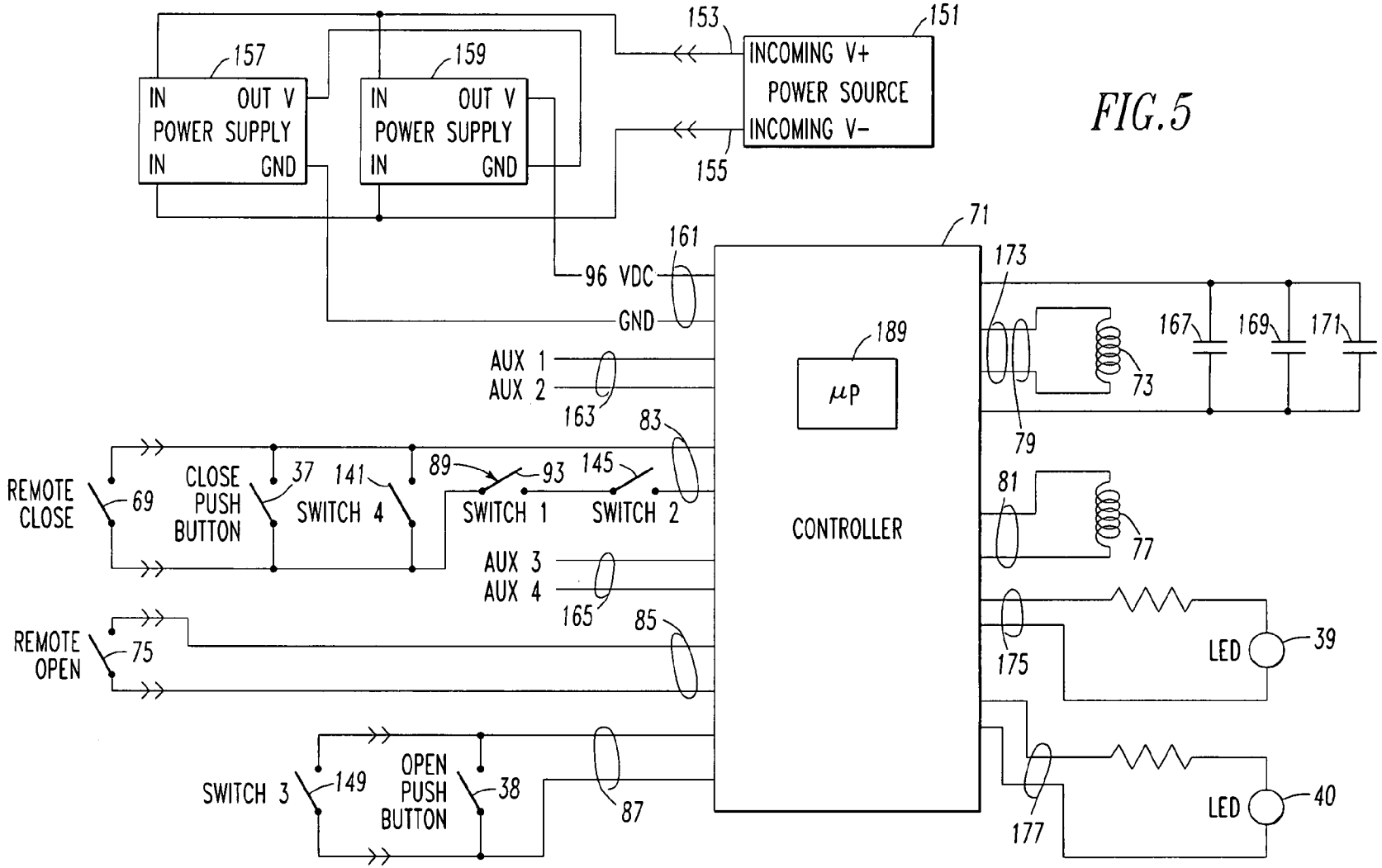
FIG. 5 is a block diagram of the wiring of the controller of the circuit breaker of FIG. 1.

Referring to FIGS. 3 and 5, in accordance with another important aspect of the circuit breaker 1, a switch, such as micro-switch 89, includes an operator 91 and a contact 93 (FIG. 5; switch 1) electrically connected in series with the close input 83 of the controller 71. The operator 91 is engaged by the pivot member handle 47 to open the contact 93 in response to partial movement of the handle 47 from its first or normal position (FIG. 7) toward the open position (FIG. 10).

Figure 4:
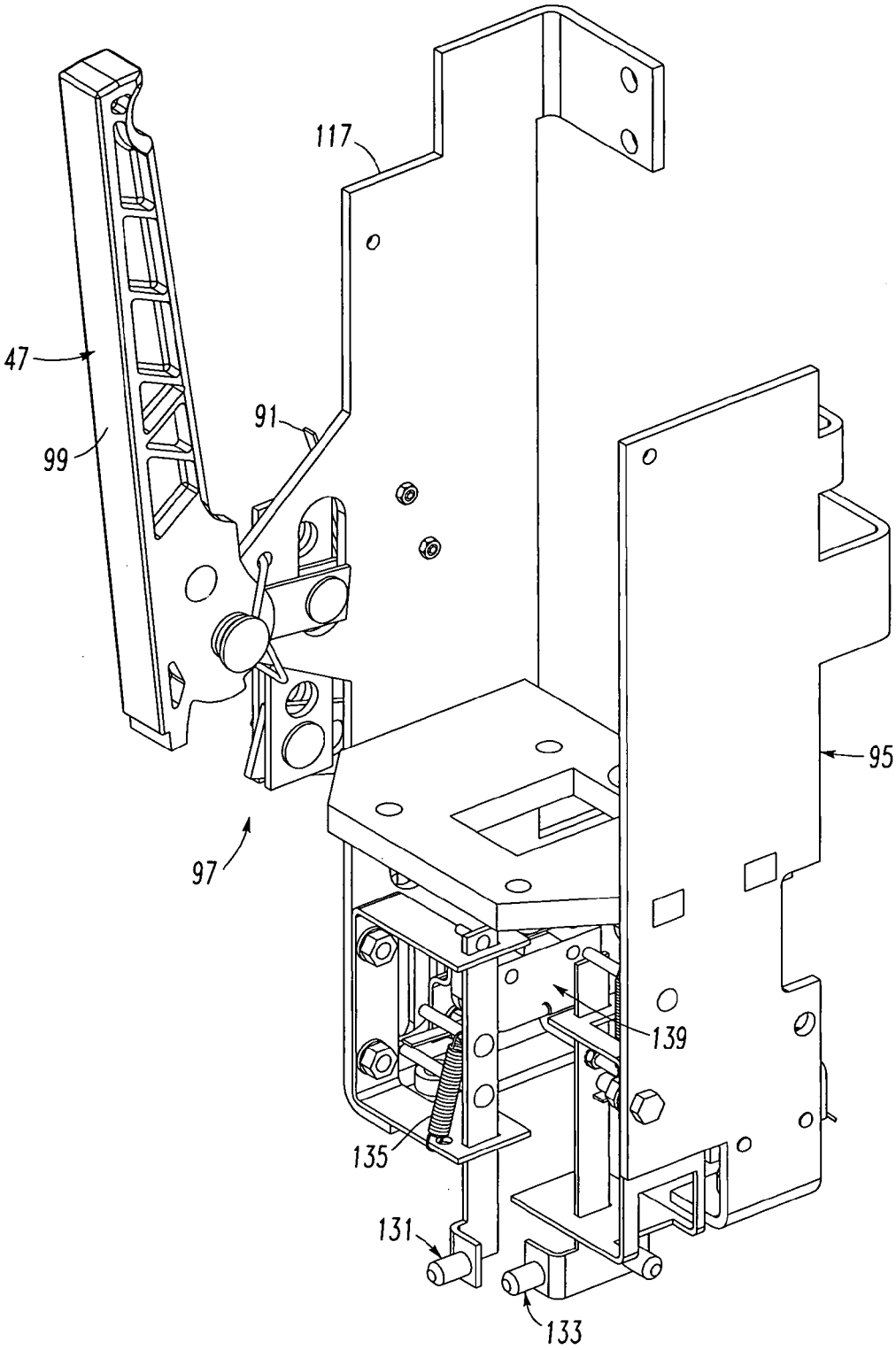
FIG. 4 is another side isometric view of the actuator box assembly of FIG. 3.
Figure 11:
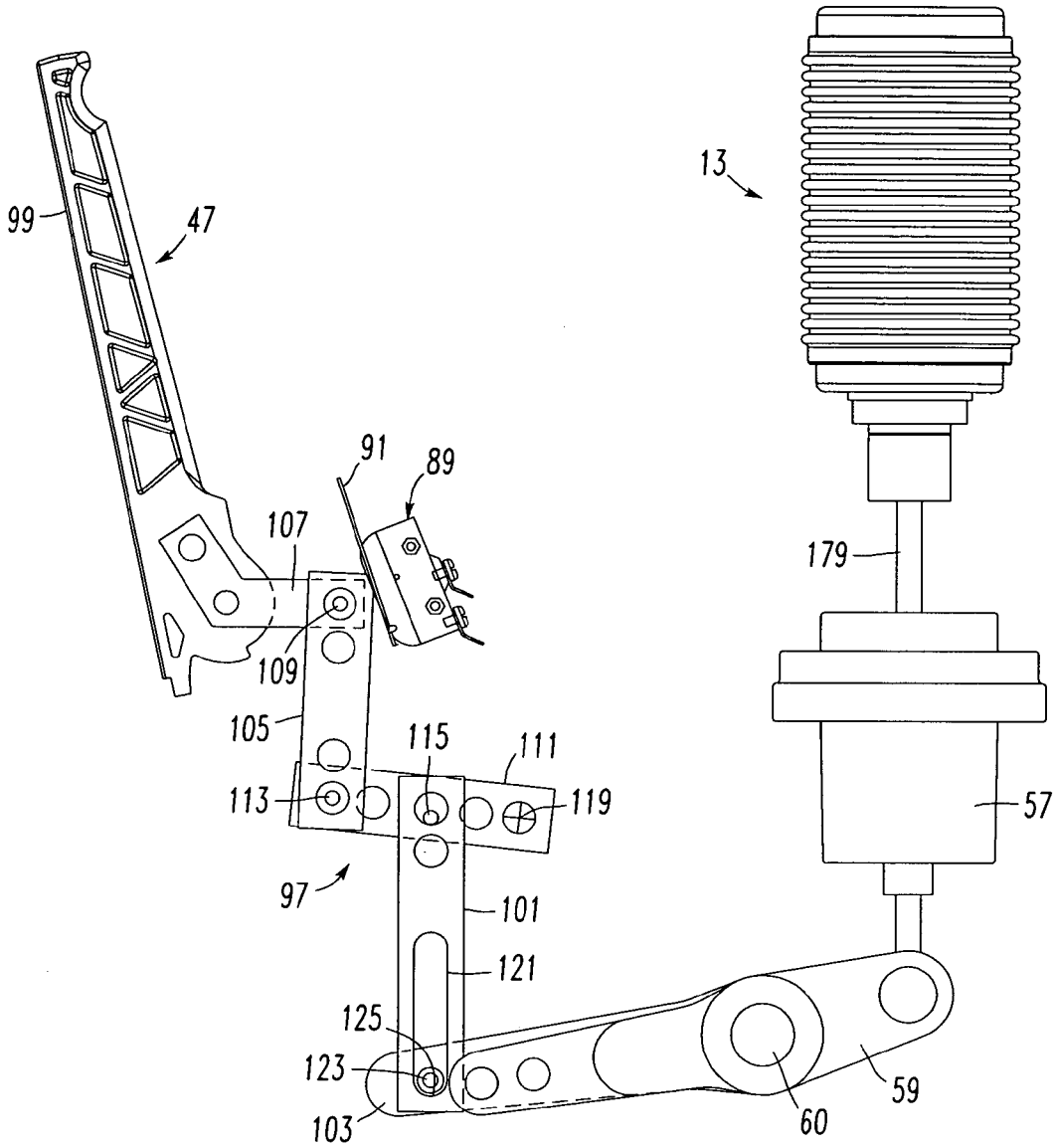
FIG. 11 is a simplified vertical side elevation view of the pivotable emergency trip lever, linkage, pole shaft and vacuum interrupter of FIG. 1 in the closed position with the micro-switch in the open position and the emergency trip lever moving from the closed position.

Referring now to FIGS. 3 and 4, an actuator box assembly 95 is shown. The pivot member handle 47 includes a linkage 97 between a handle portion 99 and the operating mechanism 33 (FIG. 1) to open the separable contacts 51 (FIG. 2) when the handle portion 99 is pivoted to the open position of FIG. 10. As best shown in FIG. 11, the linkage 97 includes a link member 101 engaging an arm 103 of the pole shaft 60.

Figure 9:
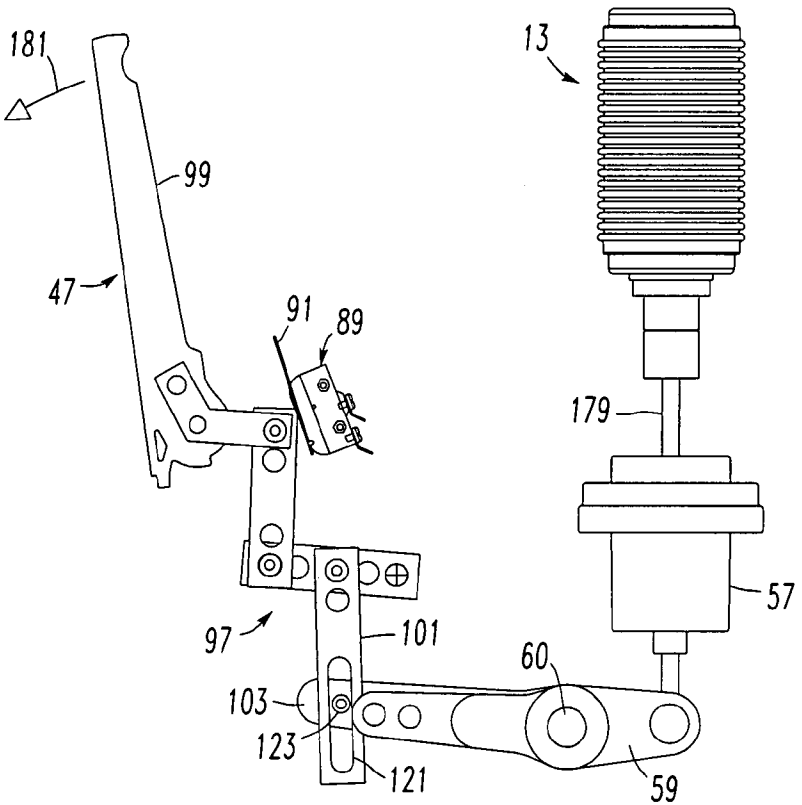
FIG. 9 is a simplified vertical side elevation view of the pivotable emergency trip lever, linkage, pole shaft and vacuum interrupter of FIG. 1 in the open position with the micro-switch in the open position and the emergency trip lever in the engagement position.

As the handle 47 pivots from the normal position (FIG. 7) to an engagement position (FIGS. 9 and 11) between that normal position and the open position (FIG. 10), the linkage 97 in general, and the upper link 105 in particular, engages the switch operator 91 in that engagement position, thereby causing the normally closed (NC) contact 93 (FIG. 5) to open in response to partial movement of the handle 97 toward the open position at the engagement position (FIGS. 9 and 11).

The linkage 97 includes the upper link 105 pivotally mounted to a leg 107 of the handle 47 by pivot member 109, an intermediate link 111 pivotally mounted to the upper link 105 by pivot member 113, and the link member 101 pivotally mounted to the intermediate link 111 by pivot member 115. The end of the intermediate link 111 opposite the pivot member 113 is pivotally mounted to a frame 117 of the actuator box assembly 95 (FIG. 3) by a pivot member 119. The link member 101 includes a longitudinal slot 121. The pole shaft arm 103 (FIG. 11) includes a pivot member 123 pivotally captured within the longitudinal slot 121.

The pivot point 123 of the pole shaft arm 103 engages the end 125 of the longitudinal slot 121 when the separable contacts 51 (FIG. 2) are closed and the handle 47 is in the position of FIG. 11. When the handle 47 is pivoted to the open position (FIG. 10), the handle leg 107 moves the upper link 105 in an upward (with respect to FIG. 11) longitudinal direction. This pivots the intermediate link 111 clockwise (with respect to FIG. 11) about the pivot member 119, which, in turn, moves the link member 101 in the same upward longitudinal direction, in order that the end 125 of the longitudinal slot 121 pivots the pole shaft arm 103 clockwise (with respect to FIG. 11). The pole shaft 60, in turn, pivots the bell crank arm 59 thereof clockwise (with respect to FIG. 11) to open the separable contacts 51 (FIG. 2) of the vacuum interrupter 13. The pole shaft 60, also, pivots the pole shaft arm 65 (FIG. 6A) to move the armature 63 of the linear actuator 50 (FIG. 6B) upward (with respect to FIG. 6B), in order to open the same.

As will be discussed below in connection with FIG. 11, the operating mechanism opening spring 67, when charged (FIG. 12), biases a pole shaft arm 127 (FIGS. 6A–6B and 12) with a first force. The linear actuator 50 (FIGS. 6A–6B, 12 and 14) includes a magnet 185 having a second force that is greater than that first force until the longitudinal slot end 125 sufficiently pivots the pole shaft arm 103, which pivots the pole shaft 60 and the arm 65 thereof to move the linear actuator armature 63, in order to open the separable contacts 51.

Although not part of the present invention, the actuator box assembly 95 of FIGS. 3 and 4 includes a floor closer lever 131 and a floor tripper lever 133. The lever 131 is normally biased downward (with respect to FIGS. 3 and 4) by spring 135, while the lever 133 is normally biased upward (with respect to FIGS. 3 and 4) by spring 137. The lever 131 is, however, allowed to go upward, with respect to FIGS. 3 and 4, whenever the circuit breaker 1 is fully withdrawn from a draw out cradle (not shown). The lever 131 normally rides in a groove (not shown) in the draw out cradle. The groove has a gap (not shown) at the fully withdrawn position (not shown) that allows such upward movement as manually initiated by an operator. In that upward position, a surface of the lever 131 actuates a close switch 139 to close a normally open close contact 141 (FIG. 5; switch 4). The lever 133 normally rides in a groove (not shown) in the draw out cradle. The shape of the groove moves the lever 133 downward (with respect to FIGS. 3 and 4) whenever the circuit breaker 1 is racked in or out of the draw out cradle. In that downward position, a surface of the lever 133 actuates a trip free switch 143 to open a normally closed contact 145 (FIG. 5; switch 2) and actuates a prevent close switch 147 to close a normally open contact 149 (FIG. 5; switch 3). These contacts 149 and 145 respectively open the circuit breaker 1 and prevent closing thereof.

FIG. 5 shows the wiring of the trip unit controller 71. A suitable power source 151 (e.g., without limitation, 100–240 VAC; 100–300 VDC) provides incoming V+ 153 and incoming V− 155 inputs to two direct current (DC) power supplies 157,159. The two DC power supplies 157,159 in this example each provide +48 VDC outputs, which are summed to provide +96 VDC at inputs 161 of the controller 71. The operating mechanism 33 of the circuit breaker 1 (FIG. 1) includes auxiliary switches (not shown) which provide AUX 1 and AUX 2 signals at 163 that are open when the circuit breaker 1 is open, and which provide AUX 3 and AUX 4 signals at 165 that are closed when the circuit breaker 1 is open.

As was discussed above, the contact 93 (switch 1) is the micro-switch normally closed contact, which inhibits the close input 83 when the handle 47 is partially actuated (FIGS. 9 and 11). Similarly, the prevent close contact 145 inhibits the close input 83 (switch 2) when the circuit breaker 1 is racked in or out and the lever 133 actuates the trip free switch 143. Otherwise, with both of the contacts 93,145 being normally closed, the close input 83 is activated from any of the remote close contact 69, the close pushbutton 37 or the normally open close contact 141 (switch 4) as closed when the lever 131 actuates the close switch 139. The first open input 85 is activated in response to closure of the remote open contact 75. The second open input 87 is activated in response to closure of the open pushbutton 38 or to closure of the contact 149 in response to the prevent close switch 147.

The controller 71 preferably includes a circuit (not shown) that maintains a reserve charge on capacitors 167, 169,171 for powering the closing coil 73 through outputs 173 that drive the close signal 79. The controller 71 also drives outputs 175 to illuminate the first LED 39 whenever the three capacitors 167,169,171 are fully charged. The controller 71 further drives outputs 177 to illuminate the second LED 40 to indicate circuit breaker wellness.

Figure 6A:
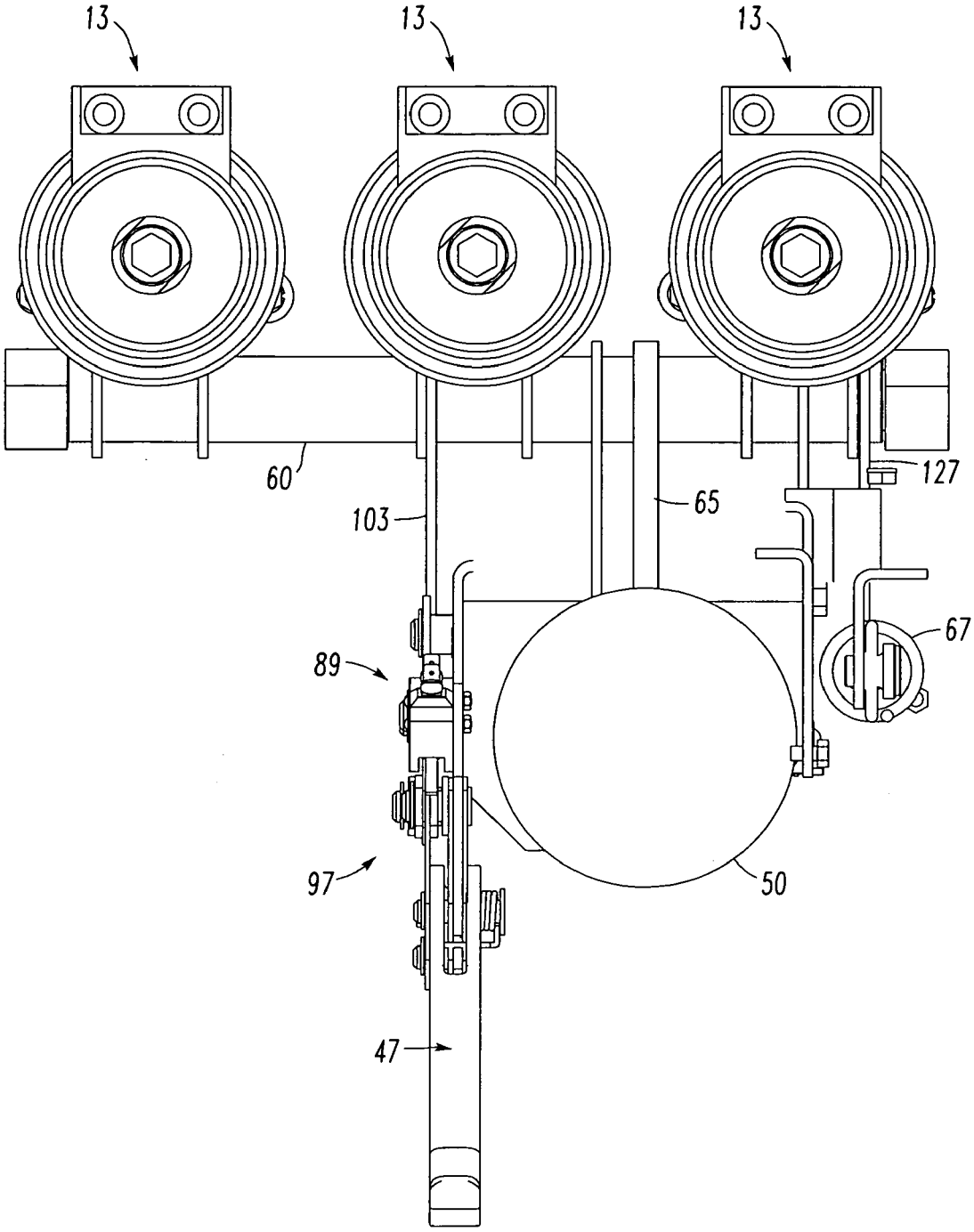
FIG. 6A is a plan view of the vacuum interrupters, pole shaft, operating arms, linear actuator, emergency trip lever and opening spring of the circuit breaker of FIG. 1.
Figure 6B:
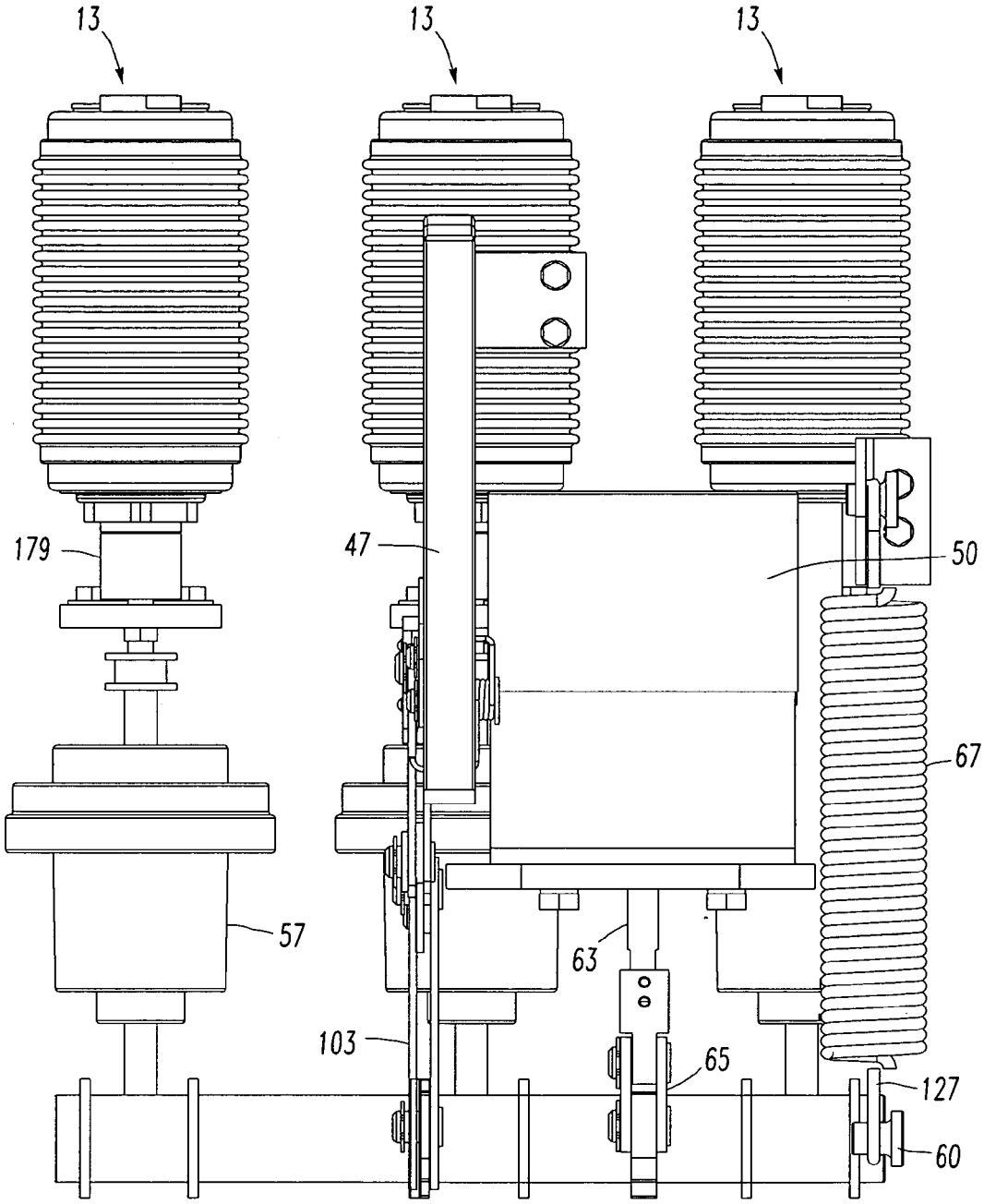
FIG. 6B is a vertical elevation view of the vacuum interrupters, pole shaft, operating arms, linear actuator, emergency trip lever and opening spring of the circuit breaker of FIG. 1.

FIGS. 6A and 6B show the three vacuum interrupters 13 (as best shown in FIG. 2), the pole shaft 60, the operating arms 65,103,127 thereof, the linear actuator 50, the emergency trip lever handle 47 and the opening spring 67. As was discussed above in connection with FIGS. 1 and 2, the cavities 9A,9B,9C house the three pole mechanisms 11, which include the three vacuum interrupters 13. Each of the vacuum interrupters 13 has a moveable stem mechanism 179 mechanically connected to the moveable contact of the separable contacts 51. Each of the moveable stem mechanisms 179 is mechanically connected through a corresponding one of the insulator/compression springs 57 to a corresponding one of the pole shaft bell crank arms 59 (FIG. 2). As was discussed above, the pole shaft operating arms 65,103,127 engage the linear actuator armature 63, the link member 101 of the linkage 97 and the opening spring 67, respectively.

Figure 7:
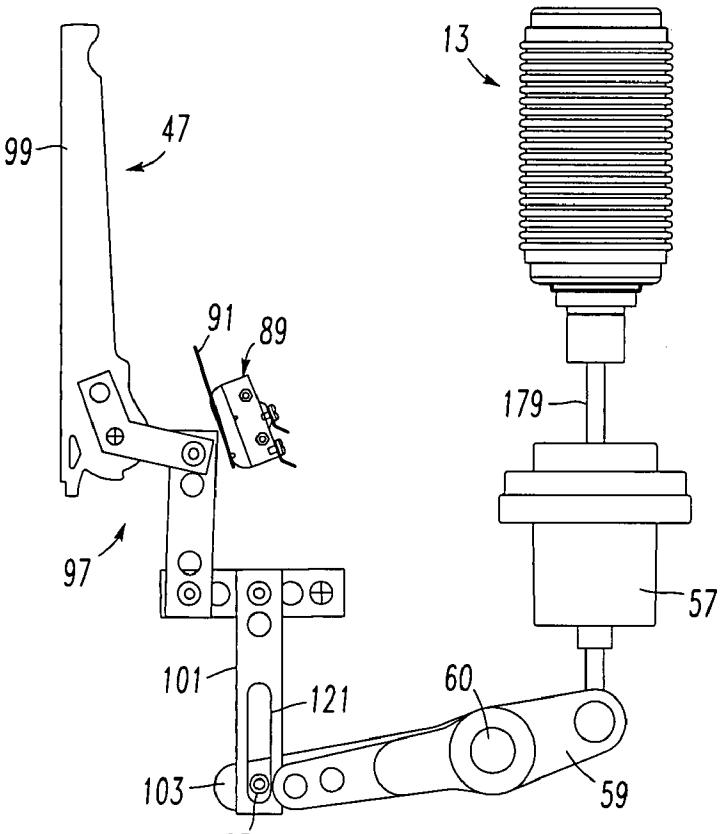
FIG. 7 is a simplified vertical side elevation view of the pivotable emergency trip lever, linkage, pole shaft and vacuum interrupter of FIG. 1 in the closed position.

FIG. 7 shows the pivotable emergency trip lever 47, the linkage 97, the pole shaft 60 and the vacuum interrupter 13 in the normal closed position. The handle portion 99 of the emergency trip lever 47 is in its at rest or normal position, and the normally closed micro-switch contact 93 (FIG. 5) is in the closed position.

Figure 8:
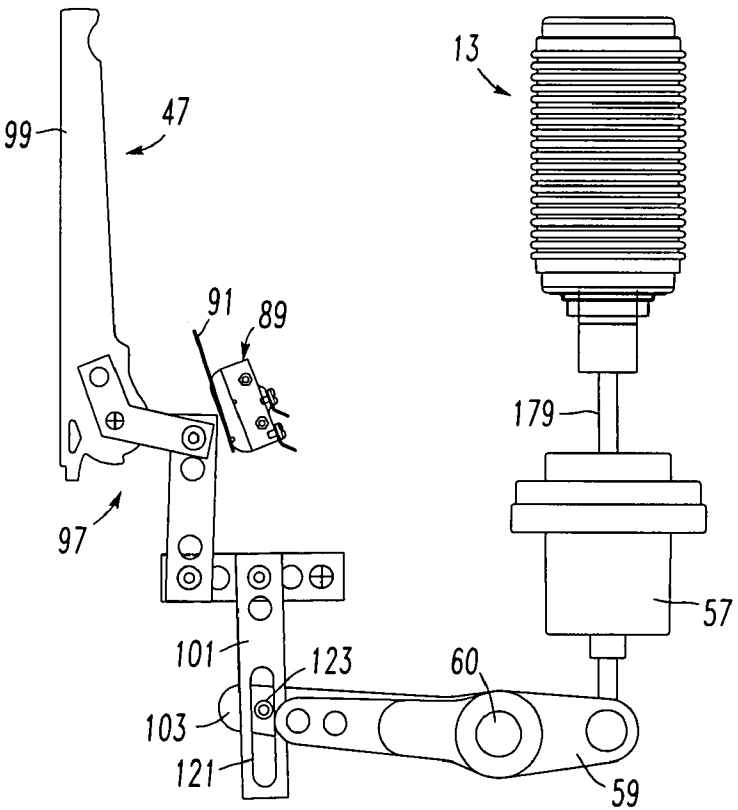
FIG. 8 is a simplified vertical side elevation view of the pivotable emergency trip lever, linkage, pole shaft and vacuum interrupter of FIG. 1 in the open position.

In FIG. 8, the handle portion 99 of the emergency trip lever 47 is in its at rest or normal position, and the normally closed micro-switch contact 93 (FIG. 5) is in the closed position. This allows a close signal at the close input 83 (FIG. 5) to be received by the controller 71, in order to responsively drive through the controller outputs 173 the close signal 79 to the closing coil 73. In this position, the pole shaft 60 and the vacuum interrupter 13 are in the open position. The pivot member 123 of the pole shaft arm 103 remains pivotally captured within the longitudinal slot 121 of the link member 101, albeit shifted upward (with respect to FIGS. 8 and 11) above the end 125 (FIG. 11) of that slot 121. The micro-switch engagement position of the handle portion 99 of FIG. 8 is preferably substantially closer to the normal position of FIG. 7 than to the open position of FIG. 10.

FIG. 9 is similar to FIG. 8 except that the handle portion 99 of the emergency trip lever 47 is slightly and sufficiently pivoted in the direction 181, in order to open the normally closed micro-switch contact 93 (FIG. 5; switch 1) and inhibit the close input 83 (FIG. 5) of the controller 71, thereby preventing a close signal from reaching such controller.

FIG. 10 is similar to FIG. 9 except that the handle portion 99 of the emergency trip lever 47 is fully pivoted in the direction 183. This maintains the open state of the normally closed micro-switch contact 93 (FIG. 5; switch 1) and continues to inhibit the close input 83 (FIG. 5) of the controller 71, thereby preventing a close signal from reaching such controller. Otherwise, if the circuit breaker 1 were to close (e.g., in response to the remote close contact 69 of FIG. 5), then the handle portion 99 would, otherwise, be quickly pulled back toward the circuit breaker 1 (i.e., toward the position of FIG. 7) along with the user's hand. However, this is prevented by disabling the close input 83.

FIG. 11 is similar to FIG. 9 except that the pole shaft 60 and the vacuum interrupter 13 are in the closed position. Here, again, the handle portion 99 of the emergency trip lever 47 is slightly and sufficiently pivoted (counterclockwise with respect to FIG. 11) from the normal position (FIG. 7), in order to open the normally closed micro-switch contact 93 (FIG. 5; switch 1) and inhibit the close input 83 (FIG. 5) of the controller 71, thereby preventing a close signal from reaching such controller. Unlike the open position of the separable contacts 51 (FIG. 2) of FIG. 9, the vacuum interrupter 13 of FIG. 11 is closed. As was discussed above, the movement of the trip lever 47 and the linkage 97 causes the lower link 101, which engages the pole shaft arm 103 through the pivot member 123, to rotate the pole shaft 60 clockwise (with respect to FIG. 11), in order to: (1) move the linear actuator armature 63 slightly upward (with respect to FIG. 6B) in response to the pole shaft arm 65; and (2) move the moveable stem mechanism 179 slightly downward (with respect to FIG. 11) in response to the bell crank arm 59. As a result of the first motion, above, the holding force of the linear actuator magnet 185 (FIG. 14) is reduced sufficiently such that the opening spring 67 overcomes the now sufficiently reduced holding force of such linear actuator magnet. As a result, the handle portion 99 needs to move only a relatively small amount in order to open the circuit breaker 1. After the force of the linear actuator magnet 185 is sufficiently reduced, the opening spring 67 provides the force to completely open the circuit breaker 1. Otherwise, the force of the opening spring 67 is normally overcome by the normal magnetic holding force of the magnet 185 that maintains the closed position of the separable contacts 51.

Figure 12:
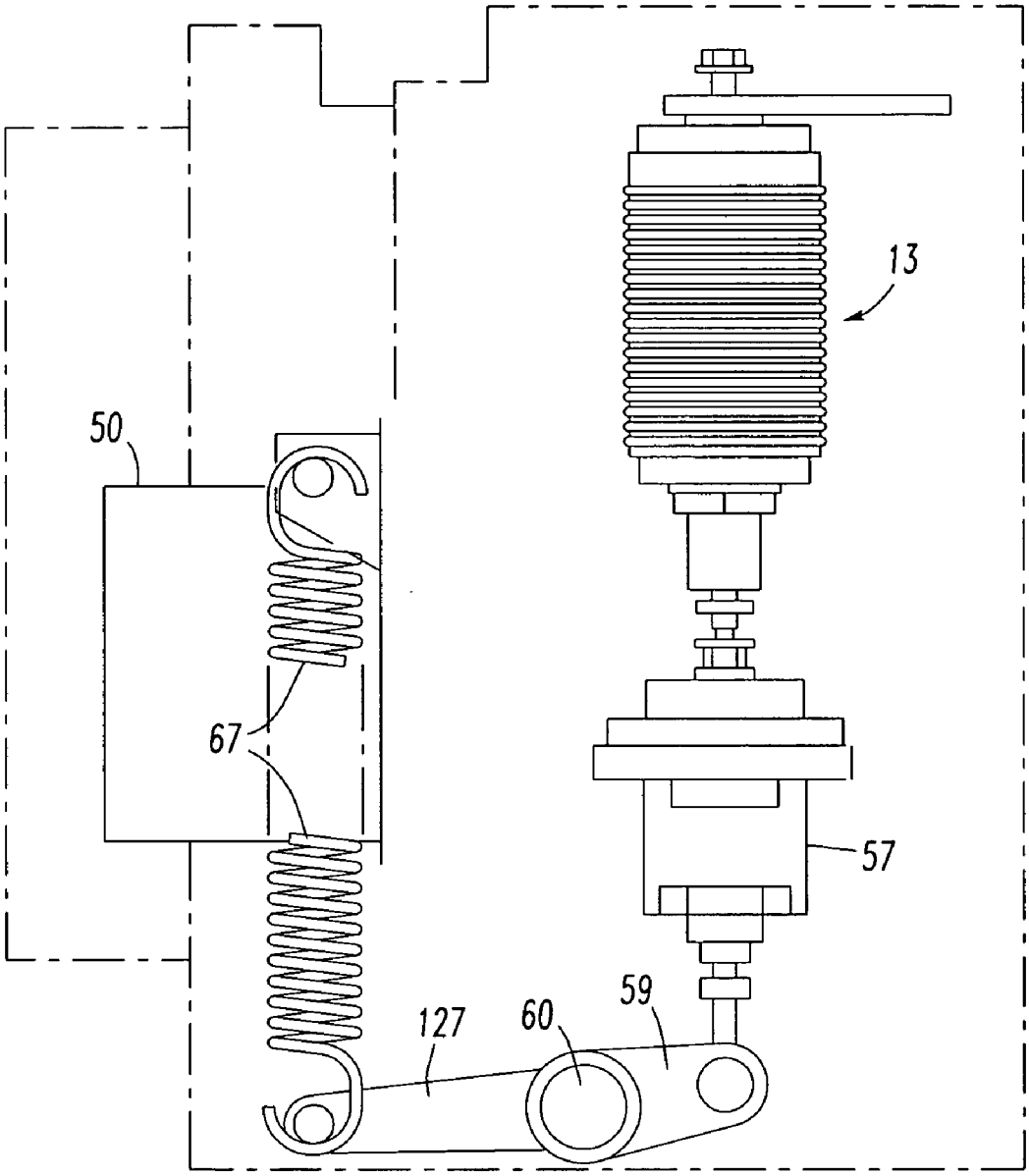
FIG. 12 is a simplified vertical side elevation view of the linear actuator, pole shaft, opening spring and vacuum interrupter of FIG. 1 in the closed position.
Figure 13:
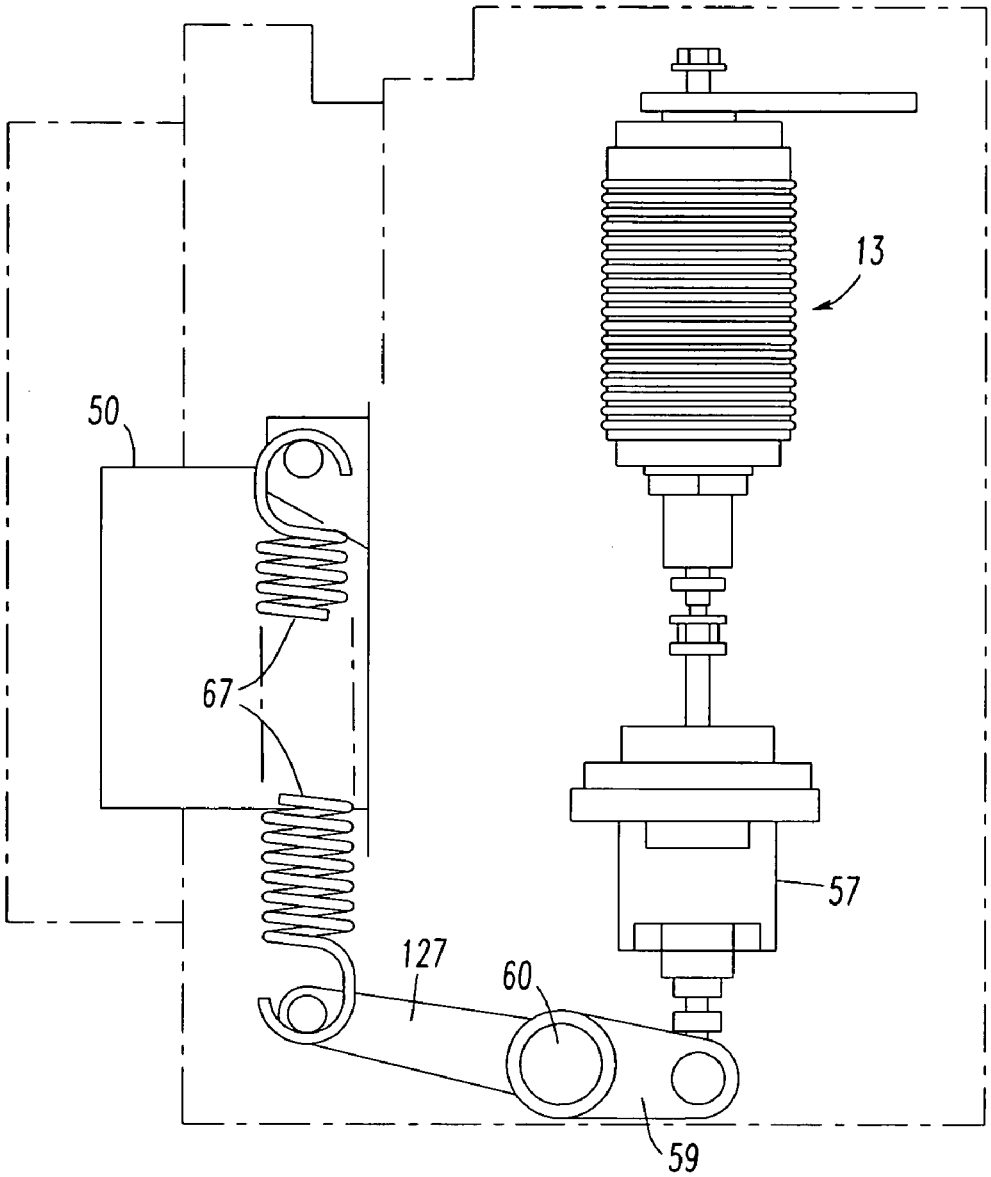
FIG. 13 is a simplified vertical side elevation view of the linear actuator, pole shaft, opening spring and vacuum interrupter of FIG. 1 in the open position.

FIG. 12 shows the linear actuator 50, pole shaft 60, opening spring 67 and the vacuum interrupter 13 in the closed position with the opening spring 67 having been charged in response to the energized closing coil 73 of the linear actuator 50. FIG. 13 is similar to FIG. 12 except that the linear actuator 50, pole shaft 60, opening spring 67 and the vacuum interrupter 13 are in the open position with the opening spring 67 being discharged.

Figure 14:
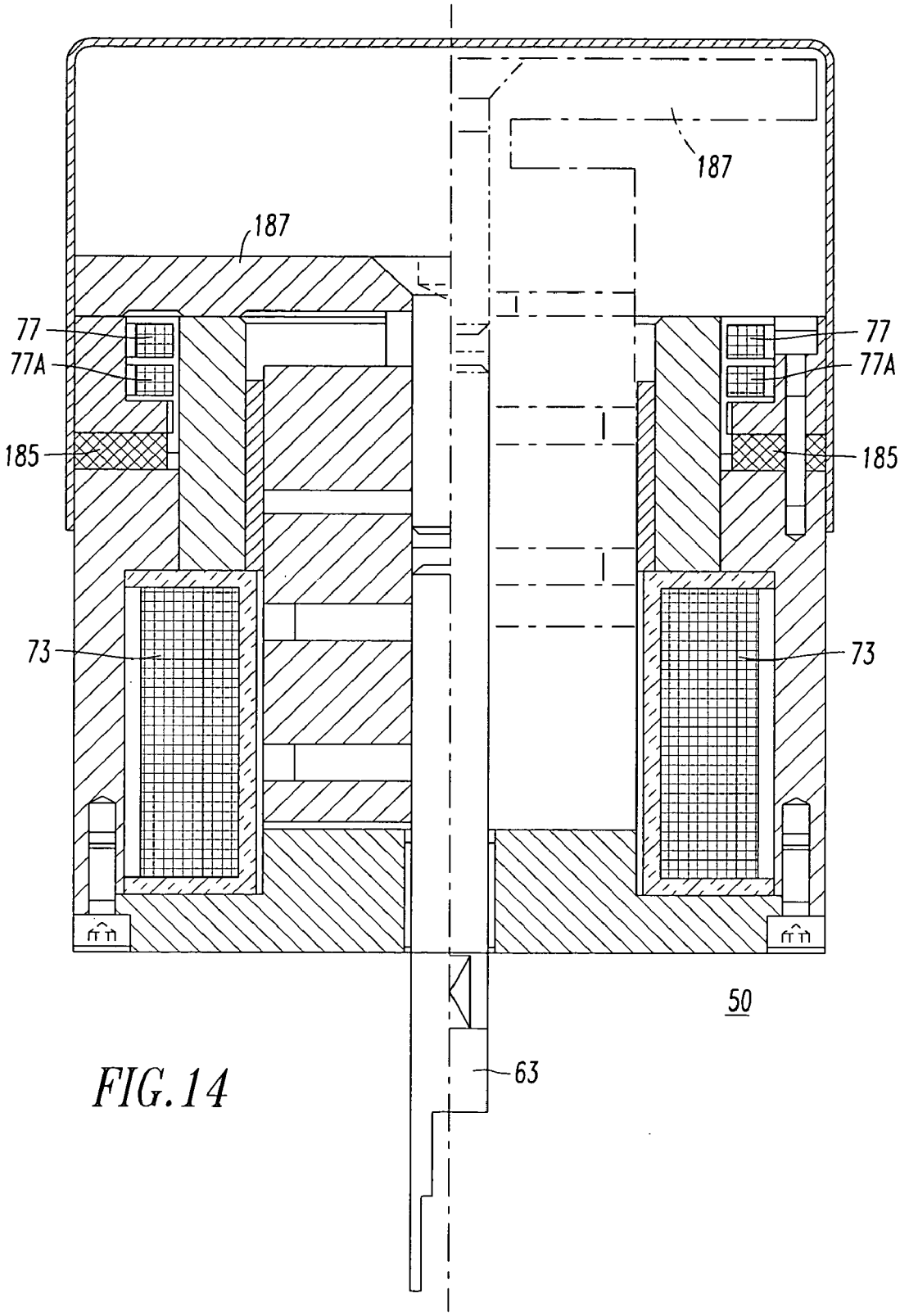
FIG. 14 is a vertical sectional view of the linear actuator of FIG. 1.

FIG. 14 shows the linear actuator 50 of FIGS. 6A–6B and 14 including the closing coil 73, the opening coil 77, the magnet 185 and the armature 63, which forms an external drive rod or plunger. The armature 63 is connected to a steel plate 187 that is attracted, as shown on the left side of FIG. 14 by the magnet 185 or by the energized state of the closing coil 73. Alternatively, the steel plate 187 is repelled, as shown on the right side of FIG. 14 in phantom line drawing, by the energized state of the opening coil 77. Although not shown in FIG. 5, the linear actuator 50 may include a second opening coil, such as 77A, that may be advantageously energized by another output (not shown) of the controller 71 (FIG. 5) (e.g., in response to failure of the first opening coil 77 or open signal 81).

Although the controller 71 of FIG. 5 includes a suitable processor (e.g., a microprocessor ($\mu$P)), it will be appreciated that a combination of one or more of analog, digital and/or processor-based circuits may be employed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit interrupter comprising:

a housing having an opening;

at least one pole mechanism comprising separable contacts;

an operating mechanism adapted to open and close the separable contacts of said at least one pole mechanism, said operating mechanism being supported by said housing;

an actuator cooperating with said operating mechanism to open and close said separable contacts, said actuator being responsive to a close signal to close said separable contacts;

a member protruding through the opening of said housing and cooperating with said operating mechanism to open said separable contacts when moved from a first position to a second position;

a close circuit including an input inputting said close signal; and a switch including an operator and a contact electrically connected in series with the input of said close circuit, said operator being engaged by said member to open said contact in response to partial movement of said member from said first position toward said second position.

2. The circuit interrupter of claim 1 wherein said housing is a molded insulative casing.

3. The circuit interrupter of claim 1 wherein said member is a pivotable emergency trip lever protruding through the opening of said housing and cooperating with said operating mechanism and said actuator to trip open said separable contacts when pivoted to said second position.

4. The circuit interrupter of claim 3 wherein said pivotable emergency trip lever includes a normal position as said first position, an open position as said second position and an engagement position between said normal position and said open position; and wherein said pivotable emergency trip lever engages the operator of said switch in said engagement position.

5. The circuit interrupter of claim 4 wherein said engagement position is substantially closer to said normal position than said open position.

6. The circuit interrupter of claim 1 wherein said switch is a micro-switch.

7. The circuit interrupter of claim 1 wherein said close circuit further includes a close pushbutton driving said close signal.

8. The circuit interrupter of claim 1 wherein said close circuit further includes a close switch driving said close signal.

9. The circuit interrupter of claim 1 wherein said close circuit further includes an external signal driving said close signal.

10. The circuit interrupter of claim 1 wherein said at least one pole mechanism includes three pole mechanisms; and wherein said housing includes three pole cavities each of which houses one of said three pole mechanisms.

11. The circuit interrupter of claim 1 wherein said actuator is a linear actuator including an armature moveable in a longitudinal direction; wherein said at least one pole mechanism includes at least one vacuum interrupter having a moveable stem mechanism; and wherein said operating mechanism includes a pole shaft having an arm engaging the moveable stem mechanism and another arm engaging the armature of said linear actuator.

12. The circuit interrupter of claim 1 wherein said actuator is a linear actuator including an armature moveable in a longitudinal direction; wherein said at least one pole mechanism includes a plurality of vacuum interrupters having a plurality of movable stem mechanisms; and wherein said operating mechanism includes a pole shaft having a first arm, a second arm and a plurality of third arms each of which engages a corresponding one of said movable stem mechanisms; wherein said linear actuator includes an armature engaging the second arm of said pole shaft; wherein said member is a pivot member including a linkage between said pivot member and said operating mechanism to open said separable contacts when said pivot member is pivoted to said second position; and wherein said linkage includes a link member engaging the first arm of said pole shaft.

13. The circuit interrupter of claim 12 wherein said pivot member includes a leg; and wherein said linkage includes a first link pivotally mounted to the leg of said pivot member, a second link pivotally mounted to said first link, and said link member pivotally mounted to said second link.

14. The power circuit interrupter of claim 13 wherein said link member includes a longitudinal slot; and wherein the first arm of said pole shaft includes a pivot point pivotally captured within said longitudinal slot.

15. The power circuit interrupter of claim 14 wherein said second link includes a first pivot point pivotally mounted to said first link, a second pivot point pivotally mounted to said link member and a third pivot point pivotally mounted to said housing.

16. The power circuit interrupter of claim 15 wherein said longitudinal slot includes an end; wherein the pivot point of the first arm of said pole shaft engages the end of said longitudinal slot when said separable contacts are closed; wherein when said pivot member is pivoted to said second position, the leg of said pivot member moves said first link in a longitudinal direction, which pivots said second link about the third pivot point, which moves said link member in said longitudinal direction, in order that the end of said longitudinal slot pivots the first arm of said pole shaft, said pole shaft pivoting the second arm thereof to move the armature of said linear actuator; wherein said operating mechanism includes an opening spring biasing the pole shaft with a first force; and wherein said linear actuator includes a magnet having a second force that is greater than said first force until the end of said longitudinal slot pivots the first arm of said pole shaft, which pivots the second arm thereof to move the armature of said linear actuator, in order to open said separable contacts.

17. The circuit interrupter of claim 1 wherein the contact of said switch is a normally closed contact electrically connected in series with the input of said close circuit; and wherein said operator is engaged by said member to open said normally closed contact in response to partial movement of said member from said first position toward said second position.

18. The circuit interrupter of claim 1 wherein said actuator includes a coil driven by the close signal of said close circuit.

19. A power circuit interrupter comprising:

a housing having an opening;

at least one vacuum interrupter comprising separable contacts;

an operating mechanism adapted to open and close the separable contacts of said at least one vacuum interrupter, said operating mechanism being supported by said housing;

a linear actuator cooperating with said operating mechanism to open and close said separable contacts, said linear actuator being responsive to a close signal to close said separable contacts;

a pivot member protruding through the opening of said housing and cooperating with said operating mechanism and said linear actuator to open said separable contacts when pivoted from a first position to a second position;

a close circuit including an input inputting said close signal; and a switch including an operator and a contact electrically connected in series with the input of said close circuit, said operator being engaged by said pivot member to open said contact in response to partial pivoting of said pivot member from said first position toward said second position.

20. A power circuit interrupter comprising:

a housing having an opening;

at least one vacuum interrupter including separable contacts;

an operating mechanism adapted to open and close the separable contacts of said at least one vacuum interrupter, said operating mechanism being supported by said housing;

a linear actuator cooperating with said operating mechanism to open and close said separable contacts;

a pivot member protruding through the opening of said housing; and a linkage between said pivot member and said operating mechanism to open said separable contacts when said pivot member is pivoted to an open position.

21. The power circuit interrupter of claim 20 wherein said operating mechanism includes a pole shaft having a first arm, a second arm and a plurality of third arms; wherein said at least one vacuum interrupter is a plurality of vacuum interrupters; wherein each of said vacuum interrupters further includes a stem mechanism responsive to a corresponding one of the third arms of said pole shaft; wherein said linear actuator includes an armature engaging the second arm of said pole shaft; and wherein said linkage includes a link member engaging the first arm of said pole shaft.

22. The power circuit interrupter of claim 20 wherein said pivot member is a pivotable emergency trip lever protruding through the opening of said housing and cooperating with said operating mechanism and said linear actuator to trip open said separable contacts when pivoted to said open position.

23. The power circuit interrupter of claim 20 wherein said operating mechanism includes a pole shaft having a first arm, a second arm and at least one third arm; wherein each of said at least one vacuum interrupter further includes a stem mechanism responsive to a corresponding one of the at least one third arm of said pole shaft; wherein said linear actuator includes an armature engaging the second arm of said pole shaft; and wherein said linkage includes a link member engaging the first arm of said pole shaft.

24. The power circuit interrupter of claim 23 wherein said pivot member includes a leg; and wherein said linkage includes a first link pivotally mounted to the leg of said pivot member, a second link pivotally mounted to said first link, and said link member pivotally mounted to said second link.

25. The power circuit interrupter of claim 24 wherein said link member includes a longitudinal slot; and wherein the first arm of said pole shaft includes a pivot point pivotally captured within said longitudinal slot.

26. The power circuit interrupter of claim 25 wherein said second link includes a first pivot point pivotally mounted to said first link, a second pivot point pivotally mounted to said link member and a third pivot point pivotally mounted to said housing.

27. The power circuit interrupter of claim 26 wherein said longitudinal slot includes an end; wherein the pivot point of the first arm of said pole shaft engages the end of said longitudinal slot when said separable contacts are closed; wherein when said pivot member is pivoted to said open position, the leg of said pivot member moves said first link in a longitudinal direction, which pivots said second link about the third pivot point, which moves said link member in said longitudinal direction, in order that the end of said longitudinal slot pivots the first arm of said pole shaft to open said separable contacts.

* * * * *